US005411183A

United States Patent [19]

Hildebrandt

[11] Patent Number: 5,411,183

[45] Date of Patent: May 2, 1995

[54] LIQUID SPRAY OR FOAM DISPENSING APPARATUS

[75] Inventor: Bodo Hildebrandt, Riedstadt, Germany

[73] Assignee: Wella Aktiengesellschaft, Darmstadt, Germany

[21] Appl. No.: 164,352

[22] Filed: Dec. 9, 1993

[30] Foreign Application Priority Data

Dec. 17, 1992 [DE] Germany ..... 9217250 U

[51] Int. Cl.[6] ..... B65D 83/00

[52] U.S. Cl. ..... 222/399; 141/18; 141/113; 222/400.7; 222/402

[58] Field of Search ..... 222/399, 400.7, 401, 222/402; 141/18, 20, 113, 354, 355, 356

[56] References Cited

U.S. PATENT DOCUMENTS

| | | | |
|---|---|---|---|
| 3,444,906 | 5/1969 | Moonan et al. | 141/20 |
| 3,462,046 | 8/1969 | Bartels | 141/20 X |
| 3,601,164 | 8/1971 | Bruce | 141/20 |
| 3,797,534 | 3/1974 | Skidmore | 141/20 X |
| 3,955,720 | 5/1976 | Malone | 222/401 X |
| 3,995,666 | 12/1976 | Michaels | 141/20 X |
| 4,093,123 | 6/1978 | Maran | 141/20 X |
| 4,154,401 | 5/1979 | Thompson | 239/373 |
| 4,341,330 | 7/1982 | Mascia et al. | 222/401 |
| 5,209,379 | 5/1993 | Dahlin | 222/401 |

FOREIGN PATENT DOCUMENTS

| | | |
|---|---|---|
| 0037035 | 7/1981 | European Pat. Off. . |
| 0442058 | 8/1991 | European Pat. Off. . |
| 0482561 | 4/1992 | European Pat. Off. . |

*Primary Examiner*—Andres Kashnikow
*Assistant Examiner*—Joseph A. Kaufman
*Attorney, Agent, or Firm*—Michael J. Striker

[57] ABSTRACT

The dispensing apparatus for a liquid spray or a foam includes a reservoir chamber; a manually operable air pump device for pressurizing the reservoir chamber with pressurized air, the manually operable air pump device including a nondetachable operating handle in a bottom region of the apparatus, a piston pump responsive to the operating handle for pressurizing air and a pressure equalizing valve communicating with an outer atmosphere; a metering valve connected with the reservoir chamber through which the foam or liquid spray is dispensed and a one-way valve connecting the manually operable air pump device with the reservoir chamber to permit flow from the manually operable air pump device to the reservoir chamber and to prevent flow from the reservoir chamber to the manually operable air pump device; and a motor driven pressurized air filling device for feeding pressurized air to the reservoir chamber for professional applications requiring repeated pressurization.

10 Claims, 4 Drawing Sheets

LIQUID SPRAY OR FOAM DISPENSING APPARATUS

BACKGROUND OF THE INVENTION

The present invention relates to an apparatus for dispensing liquid spray or foam.

A device of this type is known including a manually operable air pump having an operating handle for pressurizing a reservoir chamber with pressurized air, a metering valve connected to the reservoir chamber through which the foam or liquid spray is dispensed, a one-way valve connected between the air pump and the reservoir to block flow back from the reservoir to the air pump and a pressure equalizing valve provided in the air pump which communicates with the outer atmosphere.

This kind of liquid spray or foam dispensing device is described in European Patent Applications EP-A 0 037 035 and EP-A-0 442 058. A manually operable air pump integrated in the apparatus produces the air pressure necessary for spraying or foaming a liquid. This type of apparatus is suitable for an individual user or consumer, who uses it only two or three times per day, however not for a professional user—for example in a beauty salon—, since repeated uses of the apparatus are required in professional applications so that repeated pumping of the air pump would be necessary.

SUMMARY OF THE INVENTION

It is an object of the present invention to provide a liquid spray or foam dispensing apparatus of the above-described type which is suitable for professional use, e.g. for repeated daily applications.

It is also an object of the present invention to provide a liquid spray or foam dispensing apparatus of the above-described type which does not have the above-described disadvantage.

These objects and others which will be made more apparent hereinafter are attained in a liquid spray or foam dispensing apparatus for a liquid spray or a foam including a container or device provided with a reservoir chamber for holding a liquid from which the spray or foam is formed; manually operable air pump means for pressurizing the reservoir chamber with pressurized air, the manually operable air pump means including a nondetachable operating handle, means responsive to the operating handle for making the pressurized air and a pressure equalizing valve communicating with an outer atmosphere; a metering valve connected with the reservoir chamber and a one-way valve connecting the manually operable air pump means with the reservoir chamber to permit flow from the manually operable air pump means to the reservoir chamber and to prevent flow from the reservoir chamber to the manually operable air pump means.

According to the invention, the dispensing apparatus for foam or liquid spray also includes a pressurized air filling means for pressurizing the reservoir chamber located outside the container.

In alternative preferred embodiments of the invention means for connecting the pressurized air filling means to either the pressure equalizing valve, the metering valve or a pressurized air filling valve provided in the walls of the reservoir chamber is provided.

The dispensing apparatus for foam or liquid spray according to the present invention has the advantage of a simple structure, which permits manual operation using the hand pump or automatic operation using a pressurized air filling unit advantageously driven by an electric motor to pressurize the reservoir chamber in professional applications. The invention is particularly useful in professional applications (beauty shop) in which the air pressurizing unit is used to pressurize the reservoir.

The apparatus according to the invention can be used exclusively by a consumer with the hand operated pump or exclusively in professional applications with the air pressure filling unit for pressurizing with pressurized air. Also it is a substantial advantage that, if the air pressure filling unit fails and is not available in professional applications, the apparatus can still be pressurized using the hand pump. Thus practically no interruption of usage results. This is particularly important, when the sprayed liquid rapidly dries (in the case of hair spray, dyes, etc.).

The nondetachable operating handle 2 has the advantage—in contrast to the detachable handle of German Patent DE-PS 27 21 128—, that it cannot be lost during professional usage, so that also the apparatus can be pumped advantageously with the operating handle 2 in place.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE PREFERRED EMBODIMENTS

Figure 1:
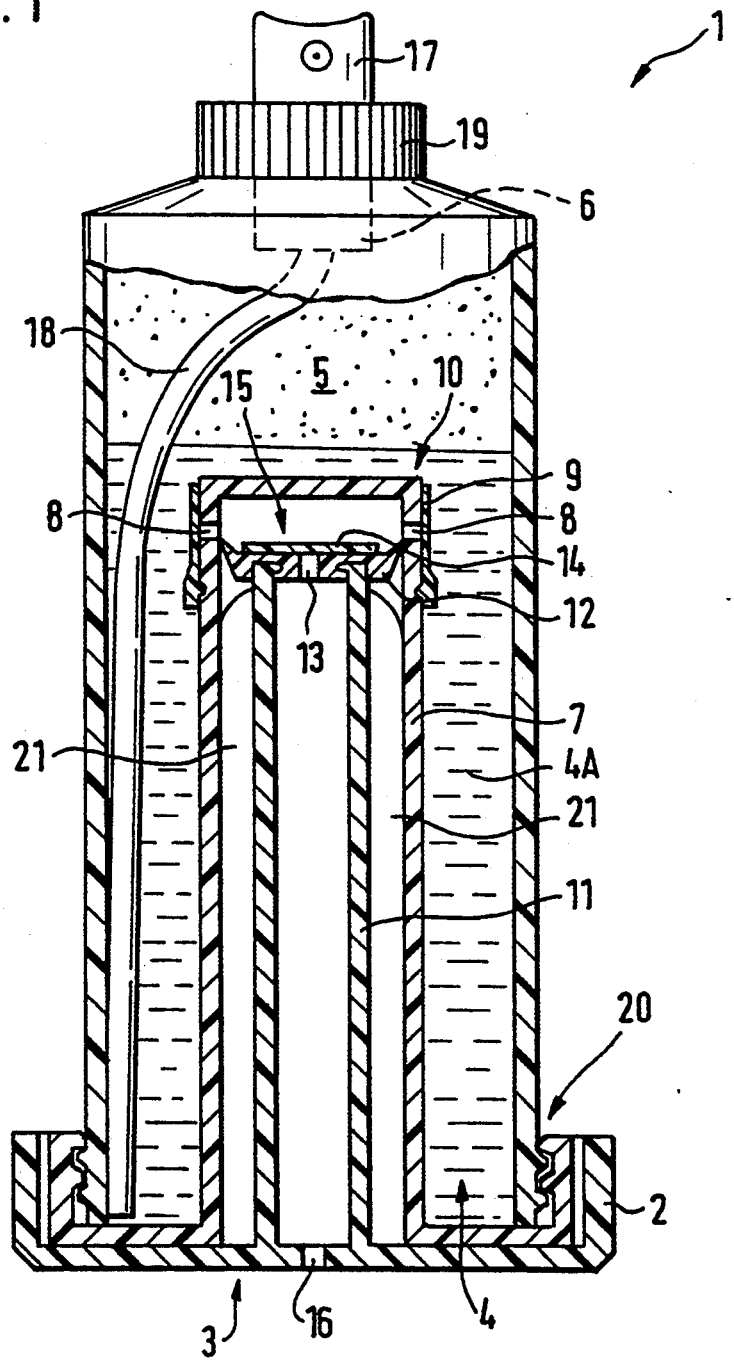
FIG. 1 is an axial cross-sectional view through a device for manually dispensing a liquid spray or foam.

An apparatus 1,22 for dispensing a liquid spray or foam according to the invention is shown in FIG. 1. This apparatus includes a device or container 1 for manually dispensing the liquid spray or foam which is provided with a metering valve 6 for delivery of an air and liquid mixture in the form of a spray or of foam and with a manually operable air pump device 3 operable by a nondetachable manual operating means, in this embodiment an operating handle 2. The manually operable air pump device 3 comprises a hollow cylinder 7, which is open at its lower end or bottom region and closed at its upper end. The upper end of the cylinder 7 is provided with a plurality of radial openings 8 which are closed by a valve tube 9 covering the upper outside surface of the hollow cylinder 7 in the vicinity of the openings. These openings 8 and the valve tube 9 together comprise a one-way valve 10 connected between the manually operable air pump device 3 and the reservoir chamber 4 and acting to allow an air flow in a direction to the reservoir chamber 4 and to prevent flow from the reservoir chamber 4. Furthermore the air pump device 3 comprises a piston pump including a slidable piston 11, which is connected to the operating handle 2. A piston head 12 located at the upper end of the slidable piston 11, forces air inside the one-way valve 10 through the openings 8 of the one-way valve 10. The piston head 12 has a central opening 13 and is provided with a valve disk 14 attached on one side and which cooperates with the central opening 13 to provide a pressure equalizing valve means 15. The bottom region or lower end of the slidable piston 11 has an opening 16, which communicates with an outer atmosphere to provide pressure equalization, when the manually operable air pump device 3 is operated by means of the operating handle 2. The metering valve 6 is connected with a riser tube 18 for conveying the liquid 4A to a valve nozzle 17. For replenishment of the liquid 4A the device 1 can be refilled by opening a top threaded cap 19 or a bottom threaded cap 20 by unscrewing the one or the other according to choice. For this purpose the slidable piston 11 is provided with radially extended ribs 21 for axial guidance.

For operation of the manually operable air pump device 3 the operating handle 2 is slid back and forth many times axially, so that pressurized air 5 is fed into the reservoir chamber 4 through the one-way valve 10. During the displacement downward of the pressurizing piston head 12 air (suction) flows into the upper hollow space of the hollow cylinder 7 for the purpose of pressure adjustment. The pressure equalization valve 15 closes during upward displacement, whereby the air in the hollow chamber of the hollow cylinder 7 is compressed and flows through the one-way valve 10 into the reservoir chamber 4 and (after being pumped many times) is available as pressurized air 5 for dispensing liquid spray or foam.

Figure 2:
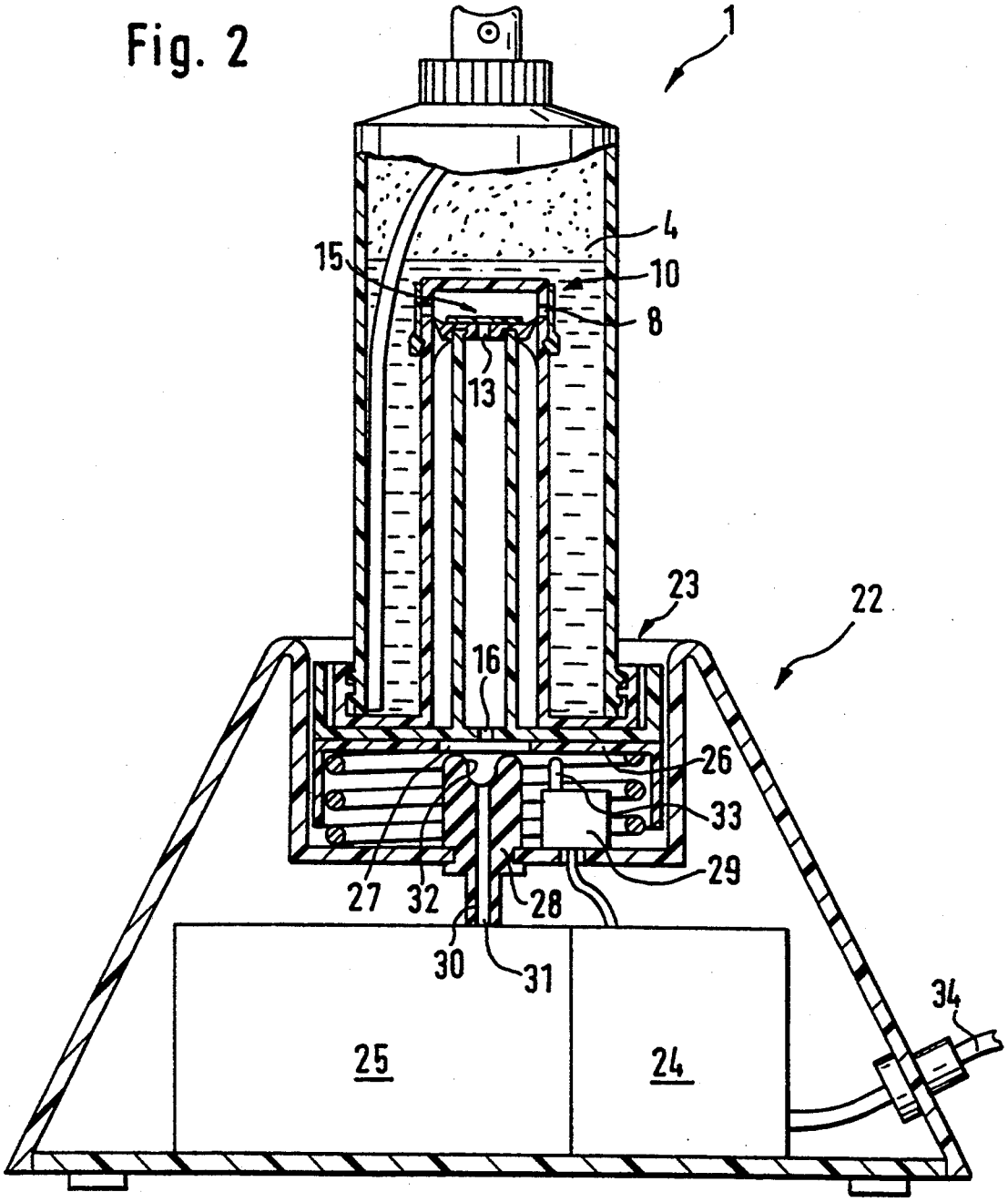
FIG. 2 is an axial cross-sectional view through a first embodiment of an apparatus for dispensing a liquid spray or foam according to the invention including a motor driven pressurized air filling device.

A motorized pressurized air filling unit 22, on which the device 1 sits, is shown in FIG. 2. The pressurized air filling unit 22 comprises a stand device 23 for holding the device 1 and an air pump device 25 driven by a drive motor 24, and can be provided with a pressurized air container if necessary. The stand device 23 is provided with a spring-loaded base 26, which has an axial central throughgoing opening 27, in order to connect a fixed pressurized air connector 28 to the opening 16 in an air-tight manner for supply of pressurized air when the container 1 is depressurized. The pressurized air connector 28 is advantageously made of a soft elastic material so that an air-tight connection with the opening 16 can be made. Advantageously the pressurized air connector 28 has a sealing ring 32 on its upper end. By pressing the device 1 into the stand device 23 the sealing ring 32 encloses the opening 16 in an air-tight manner after a short displacement and a switch 29 provided in the stand device 23 is activated by the downwardly pressing base 26, whereby the drive motor 24 operates the air pump 25 which then pumps pressurized air 5 through a hose section 30 to a pressurized air duct 31 and from there through the opening 16 of the device 1 and proceeds further through the pressure equalization valve 15 and the one-way valve 10 into the chamber 4. The switch 29 is activated by a push button 33, and is advantageously a microswitch. An unshown external energy source, which is connected with a cable 34 to the device 1, acts to supply current to the drive motor 24. However the pressurized air filling unit 22 can be supplied as a cableless or wireless unit in which the current is supplied from inside the pressurized air filling unit 22 which is battery operated after recharging or changing batteries when they are exhausted.

Figure 3:
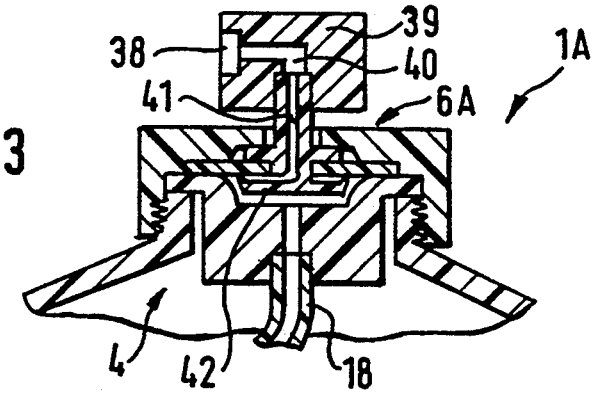
FIG. 3 is a detailed axial cross-sectional view of a second embodiment of an apparatus according to the invention taken through a metering valve of that apparatus.

In another embodiment of the invention shown in FIG. 3 a metering valve 6A is provided instead of the metering valve 6 shown in FIGS. 1 and 2. This metering valve 6A is described in German Patent Application DE-C-27-21 128 in FIGS. 2 to 4. This metering valve 6A can spray a liquid 4A from the device 1A for manually dispensing it or can be connected for external filling with pressurized air 5. The pressurized air 5 passes through an outlet opening 38 of a valve nozzle 39, a nozzle duct 40, a valve push button duct 41, over a valve plate 42 and then finally through the riser tube 18 into the chamber 4. The metering valve in other embodiments can have a separate air and liquid feed means connected to a mixing chamber in the nozzle valve and is optionally provided with a foam producing device. Of course means for filling with pressurized air in professional applications must be provided in this embodiment and is described hereinbelow.

Figure 4:
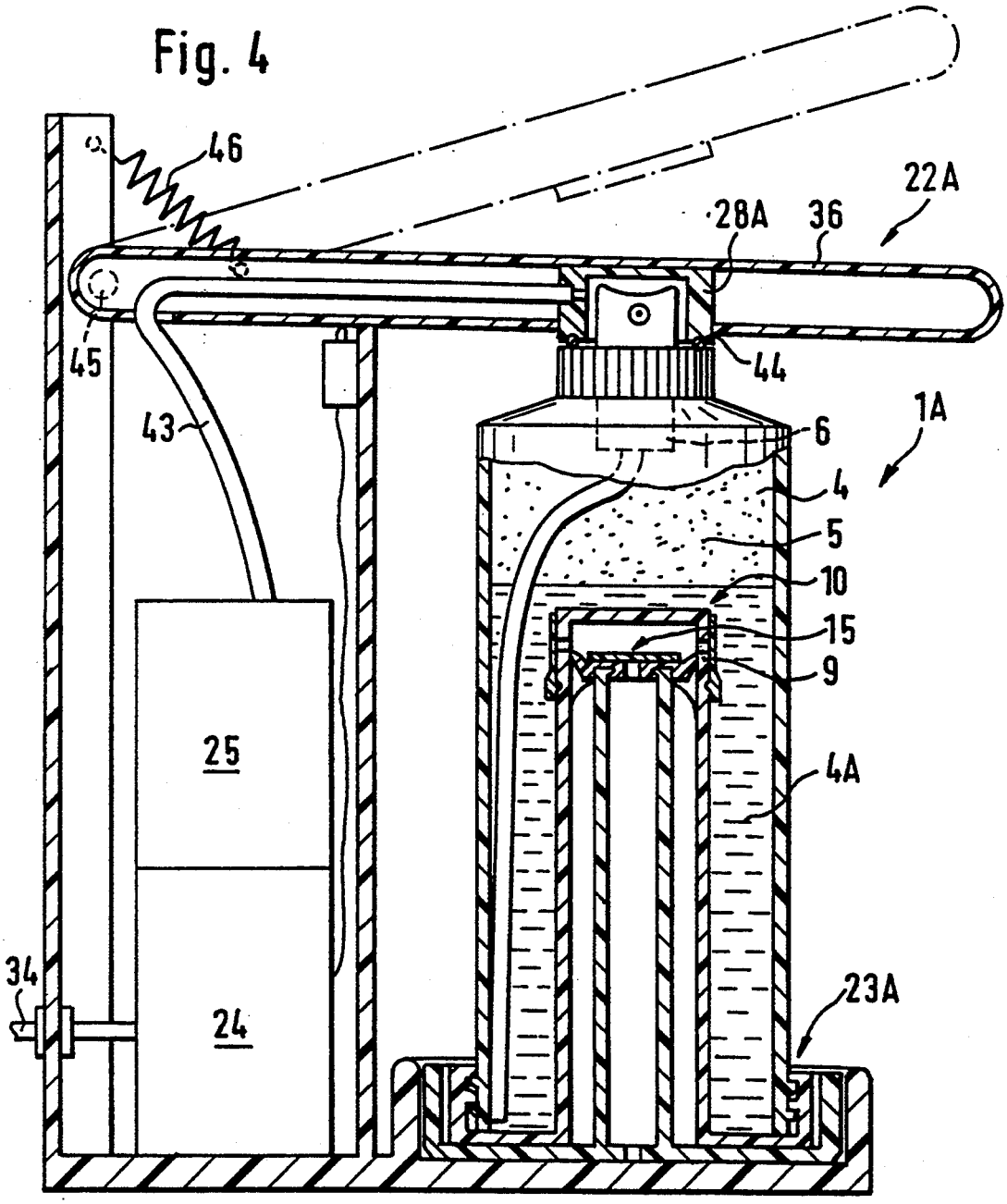
FIG. 4 is an axial cross-sectional view through the second embodiment of an apparatus for dispensing a liquid spray or foam of FIG. 3.

A suitable pressurized air filling unit 22A for filling pressurized air 5 into the device 1A through the metering valve 6A shown in FIG. 3 is shown in FIG. 4. The unit 22A consists essentially of a motor driven air pump 25, which is connected to the electric motor 24, and a pivotally mounted lever arm 36, which has a pressurized air connecting tube 43 connected to the air pump 25. The pressurized air connector 28A with sealing ring 44 is provided as a pressurized air connecting means and is located on the lever arm 36. The lever arm 36 is provided with a tensioning spring 46 and pivotally mounted at one end on a pivot 45. The tensioning spring 46 normally holds the lever arm 36 in the position shown with the dot-dashed lines in FIG. 4. The device 1A is set in a stand device 23A for filling with pressurized air 5 on which the lever arm 36 is pivotally mounted and the lever arm 36 is moved manually from the dot-dashed indicated position into the opposite position against the spring force illustrated with solid lines, whereby a switch connecting the motor with an unshown source of power is activated so that the motor 24 is operated and/or the air pump is driven. The device 1A is pressurized as a result with pressurized air 5 passed through the tube 43 connected to the pump 25 and the connector 28A, the pressurized air connector 28A and the metering valve 6A. After that the lever 36 is released, whereby it returns to the raised position indicated with dot-dashed lines. Then the device 1A can be used again.

Figure 5:
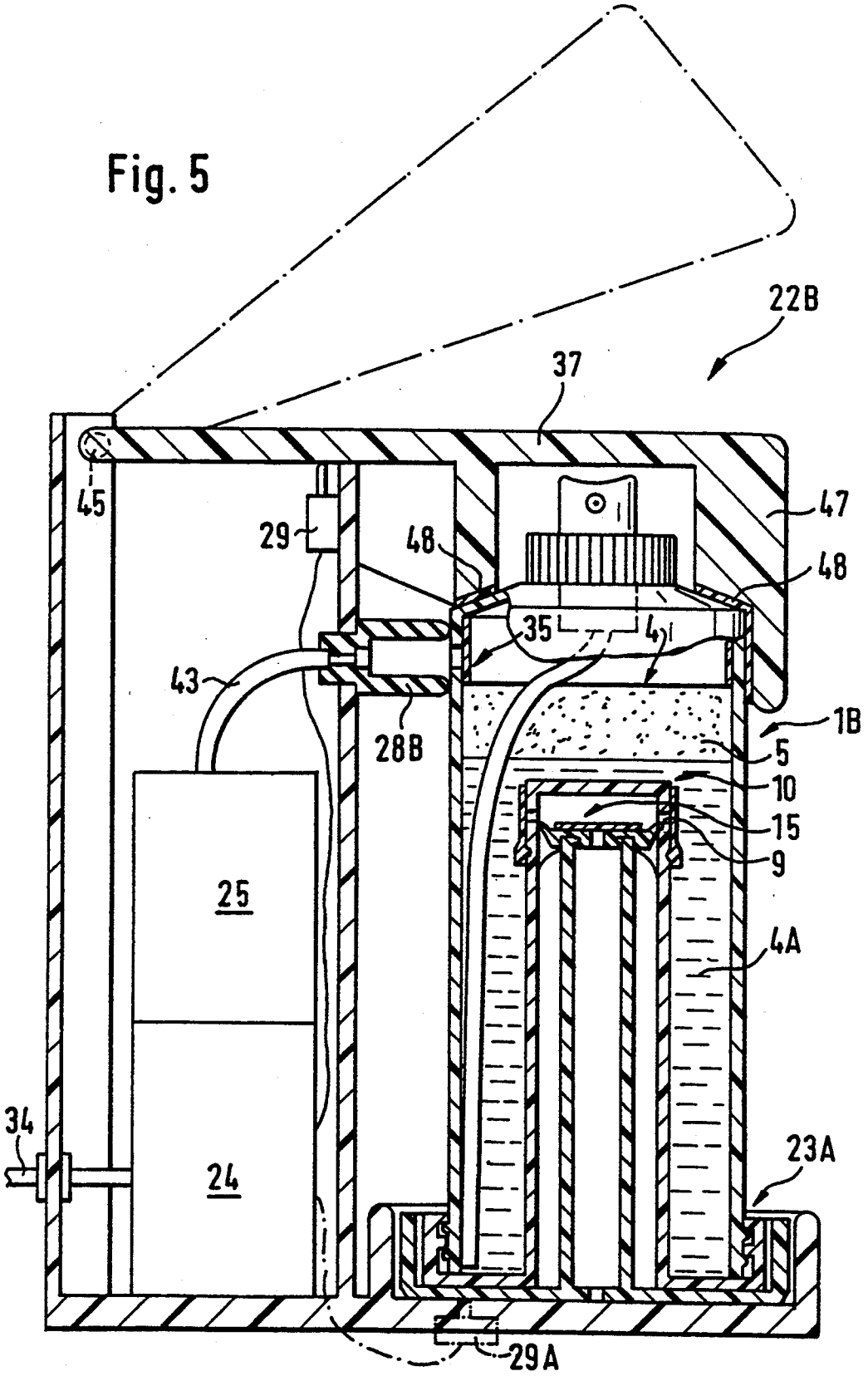
FIG. 5 is an axial cross-sectional view through a third embodiment of an apparatus for dispensing a liquid spray or foam according to the invention.

Another embodiment of a pressurized air filling device 22B—similar to that of FIG. 4—is shown in FIG. 5. So that the device 1B can be filled with pressurized air 5 it is provided with a lateral pressurized air filling valve 35. A plate or tube valve is provided as the pressurized air filling valve 35. For filling with the pressurized air 5 the pressurized air filling valve 35 is brought into contact with the pressurized air connector 28B by action of the bearing member 47 of the downwardly pressed lever arm 37 on the device 1B. A switch 29 is operated by the downwardly pressed lever arm 37, which—as described above—activates the air pump 25. Another switch 29A shown with dot-dashed lines can be provided so that the air pump 25 is activated only when a device 1B is in the stand device 23A of the unit 22B, which can be accomplished by serial electrical connection of both switches 29 and 29A. As a protection against misalignment on contact the lever arm 37 and the bearing member 47 can be provided with a suitable coating 48 for bearing against the contacting surfaces of the device 1B.

The device 1, 1A, 1B and/or the pressurized air filling unit 22, 22A, 22B can be provided with an unshown safety device for preventing excessive pressures in the device 1, 1A, 1B for manually dispensing the foam or liquid spray.

The apparatus for dispensing foam or liquid spray is advantageously made from a plastic material.

While the invention has been illustrated and embodied in a liquid spray or foam dispensing apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art,fairly constitute essential characteristics of the generic or specific aspects of this invention.

What is claimed is new and desired to be protected by Letters Patent is set forth in the appended claims.

I claim:

1. Dispensing apparatus comprising a container provided with a reservoir chamber for holding a liquid;

a metering valve connected to said reservoir chamber for dispensing purposes;

a manually operable air pump means for pressurizing said reservoir chamber with pressurized air, said manually operable air pump means including a piston pump having a piston, a nondetachable operating handle connected to said piston by which said piston can be manipulated so that said piston pump pressurizes said reservoir chamber with said pressurized air and a pressure equalizing valve communicating with an outer atmosphere, said operating handle being provided with a throughgoing opening communicating with and adjacent to said the pressure equalizing valve;

a one-way valve connecting said manually operable air pump means with said reservoir chamber to permit flow from said manually operable air pump means to said reservoir chamber and to prevent flow in said reservoir chamber from said reservoir chamber to said manually operable air pump means; and pressurized air filling means for feeding said pressurized air to said reservoir chamber, wherein said pressurized air filling means is located outside said container and includes a pressurized air connector connectable in an air-tight manner with said throughgoing opening of said operating handle through which said pressurized air can be fed.

2. Dispensing apparatus as defined in claim 1, wherein said container is provided with a base region and said operating handle is located in said base region.

3. Dispensing apparatus as defined in claim 1, wherein said pressurized air filling means located outside said container includes an electric motor and an air pump connected to said electric motor for making said pressurized air fed to said reservoir chamber.

4. Dispensing apparatus as defined in claim 1, wherein said pressurized air filling means is shaped like a truncated cone and includes a frustrum shaped stand device.

5. Dispensing apparatus comprising a container having a base region and provided with a reservoir chamber for holding a liquid;

a metering valve connected to said reservoir chamber for dispensing purposes;

a manually operable air pump means for pressurizing said reservoir chamber with pressurized air, said manually operable air pump means including a nondetachable operating handle located in said base region of said container and means responsive to said operating handle for making said pressurized air;

a pressure equalizing valve communicating with an outer atmosphere;

a one-way valve connecting said manually operable air pump means with said reservoir chamber to permit flow from said manually operable air pump means to said reservoir chamber and to prevent flow from said reservoir chamber to said manually operable air pump means;

pressurized air filling means for feeding said pressurized air to said reservoir chamber, said pressurized air filling means being located outside said container; and means for connecting said pressurized air filling means to said metering valve so that said pressurized air in said pressurized air filling means can flow through said metering valve into said reservoir chamber.

6. Dispensing apparatus as defined in claim 5, wherein said manually operable air pump means includes a piston pump having a piston and said operating handle is connected with said piston.

7. Dispensing apparatus as defined in claim 6, wherein said pressure equalizing valve is included in said piston.

8. Dispensing apparatus as defined in claim 5, wherein said operating handle is provided with a throughgoing opening adjacent to and communicating with said pressure equalizing valve.

9. Dispensing apparatus as defined in claim 5, wherein said pressurized air filling means comprises a pivotally mounted lever arm having a pressurized air connecting means fixed thereon for holding and filling through said metering valve.

10. Dispensing apparatus as defined in claim 5, wherein said pressurized air filling means located outside said container includes an electric motor and an air pump connected to said electric motor for making said pressurized air fed to said reservoir chamber.

* * * * *